US006974272B2

(12) United States Patent
Furukawa et al.

(10) Patent No.: US 6,974,272 B2
(45) Date of Patent: Dec. 13, 2005

(54) WRITING INSTRUMENT CAP

(75) Inventors: Kazuhiko Furukawa, Kouza-gun (JP); Yojiro Sano, Setagaya-ku (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/433,945

(22) PCT Filed: Jan. 10, 2002

(86) PCT No.: PCT/JP02/00086

§ 371 (c)(1),
(2), (4) Date: Jun. 9, 2003

(87) PCT Pub. No.: WO02/055316

PCT Pub. Date: Jul. 18, 2002

(65) Prior Publication Data

US 2004/0028465 A1 Feb. 12, 2004

(30) Foreign Application Priority Data

Jan. 10, 2001 (JP) ..... 2001-002006

(51) Int. Cl.[7] ..... B43K 23/12
(52) U.S. Cl. ..... 401/247; 401/243
(58) Field of Search ..... 401/243, 246, 401/247, 104, 105, 106; 24/11 R, 11 HC, 24/115, 10 R

(56) References Cited

U.S. PATENT DOCUMENTS

| | | | | |
|---|---|---|---|---|
| 4,990,015 | A * | 2/1991 | Perrin | 401/243 |
| 5,427,464 | A * | 6/1995 | Nakagawa | 401/243 X |
| 5,601,376 | A * | 2/1997 | Badr et al. | 401/104 |

FOREIGN PATENT DOCUMENTS

| | | |
|---|---|---|
| JP | 197889 | 8/1996 |
| JP | 169196 | 6/1997 |
| JP | 22579697 | 6/1998 |
| JP | 2000-043477 | 2/2000 |

* cited by examiner

*Primary Examiner*—David J. Walczak
(74) *Attorney, Agent, or Firm*—Buchanan Ingersoll PC

(57) ABSTRACT

A writing instrument cap having a clip as a separate part. The clip attachment, to which the clip is fitted, is projectively formed on the outer periphery of the cap. The clip attachment is formed with a vent hole penetrating between the interior and exterior of the cap and raised portions for attachment of the clip. The raised portions are provided on both sides of the vent hole, with respect to the circumference of the cap. When the clip is attached to the clip attachment, the clip covers the clip attachment and the vent hole and creates a clearance between the clip interior and the clip attachment so as to establish an air passage that communicates between the vent hole and the outside atmosphere.

8 Claims, 8 Drawing Sheets

WRITING INSTRUMENT CAP

TECHNICAL FIELD

The present invention relates to a writing instrument cap.

BACKGROUND OF THE INVENTION

Generally, for writing instruments such as oil-based ball-point pens, water-based ball-point pens, a removable cap for protecting the front end of the writing part by enclosing it when unused is provided.

Particularly, in some kinds of writing instruments, in order to avoid the writing part drying, the tip part is hermetically enclosed by the cap so that the part can be isolated from the outside air.

However, there is a hazard risk such as from choking if an infant accidentally swallows the cap which is of a hermetic type with no ventilation.

To avoid this, various cap configurations have been known: for example, a cap is composed of outer and inner sleeves with a vent hole for ventilation provided in their connecting portion; and the external form of a cap body is shaped with projections and indentations so as to form gaps for ventilation.

Specifically, there is a configuration in which a vent hole is formed at the front end of the cap, as disclosed in Japanese Patent Application Laid-open Hei 8 No. 197889 and Japanese Patent Application Laid-open Hei 9 No. 169196. There is another proposal in which a vent hole is formed on the cap's outer periphery so as to establish communication for ventilation between the interior and exterior of the cap, as disclosed in Japanese Patent Application Laid-open No.2000-43477.

Further, Japanese Registered Utility Model No.2579697 has disclosed a configuration in which a cap having an integral clip is formed so that the sectional shape of the clip attachment is constricted in the middle, whereby the constricted part would create air channels in case an infant accidentally swallowed the cap.

However, the above configurations suffer difficulties in the forming process because of their cap shape complexity and difficulties in assembly because of their structure complexity. In addition, formation of a vent hole in the outer periphery spoils the outside appearance.

The present invention has been devised in view of the above conventional problems, it is therefore an object of the present invention to provide a writing instrument cap which is simple in structure and can assure air passage in case of an accidental swallowing, without any loss of external appearance.

BRIEF SUMMARY OF THE INVENTION

In order to attain the above object, the present invention has the following configurations.

The present invention relates to a writing instrument cap, which has a clip as a separate part, and is characterized in that a clip attachment to which the clip is fitted is projectively formed on the outer periphery of the cap, the clip attachment is formed with a vent hole penetrating between the interior and exterior of the cap and raised portions for attachment of the clip, on both sides, with respect to the circumference, of the vent hole, and in the state where the clip is set to the clip attachment, the clip covers the clip attachment and the vent hole and creates a clearance between the clip interior and the clip attachment so as to establish an air passage that communicates between the vent hole and the outside.

It is preferred that the cap is composed of a cap body and a crown portion which are separable one from the other, and the clip attachment is formed in the crown portion.

It is also preferred that the cap has a depressed portion formed along the contour of the clip attachment.

It is also preferred that the cap includes an inner cap disposed therein for sealing the vicinity of the point assembly of the writing instrument body, wherein an air channel that communicates between the spaces being separated by the inner cap, or the front end side space and the writing instrument body side space, inside the cap, is formed around the outer periphery of the inner cap when the cap is fitted to the writing instrument body.

Further, it is preferred that the clip has an attachment portion at one end thereof to be attached to the cap and the attachment portion is arranged on the outer periphery of the cap so as not to extend beyond the front end of the cap while the other clip end is formed to be a free end, which is arranged on the periphery of the cap so as not to extend beyond the writing instrument body side end of the cap.

Still, it is preferred that the vent hole formed in the cap is configured so as not to be visible.

According to the present invention, the clip attachment to which the clip is fitted is protectively formed on the outer periphery of the cap and the clip attachment is formed with the vent hole penetrating between the interior and exterior of the cap. When the clip is set to the clip attachment, the vent hole is covered by the clip, hence cannot be externally seen. As a result, it is possible to create an air path for protection against choking without any loss of appearance.

Further, since the cap is constructed of a cap body and crown portion which can be separated and put together, the complex cap configuration can be divided into simple components and partially modified. In addition, cap assembly can be simplified.

Since the depressed portion is formed along the contour of the clip attachment, the depressed portion secures an air path in a case where the cap is accidentally swallowed. Accordingly, it is possible to improve the ventilation together with the vent hole formed on the outer periphery of the cap.

Even in the case where the cap incorporates the inner cap for sealing the vicinity of the point assembly of the writing instrument body, provision of the air channel around the periphery of the inner cap makes it possible to secure an air passage for protection from choking while keeping correct sealing around the point assembly.

Since the clip length is specified so as not to exceed the cap length so that the clip does not project beyond the cap end, this arrangement provides the function without snagging and makes itself stylish in appearance.

Further, configuration of the vent hole in the cap so as not to be visible provides a stylish appearance.

DETAILED DESCRIPTION OF THE PREFERRED EMBODIMENTS

The embodiments of the present invention will herein below be described in detail with reference to the drawings.

Figure 1:
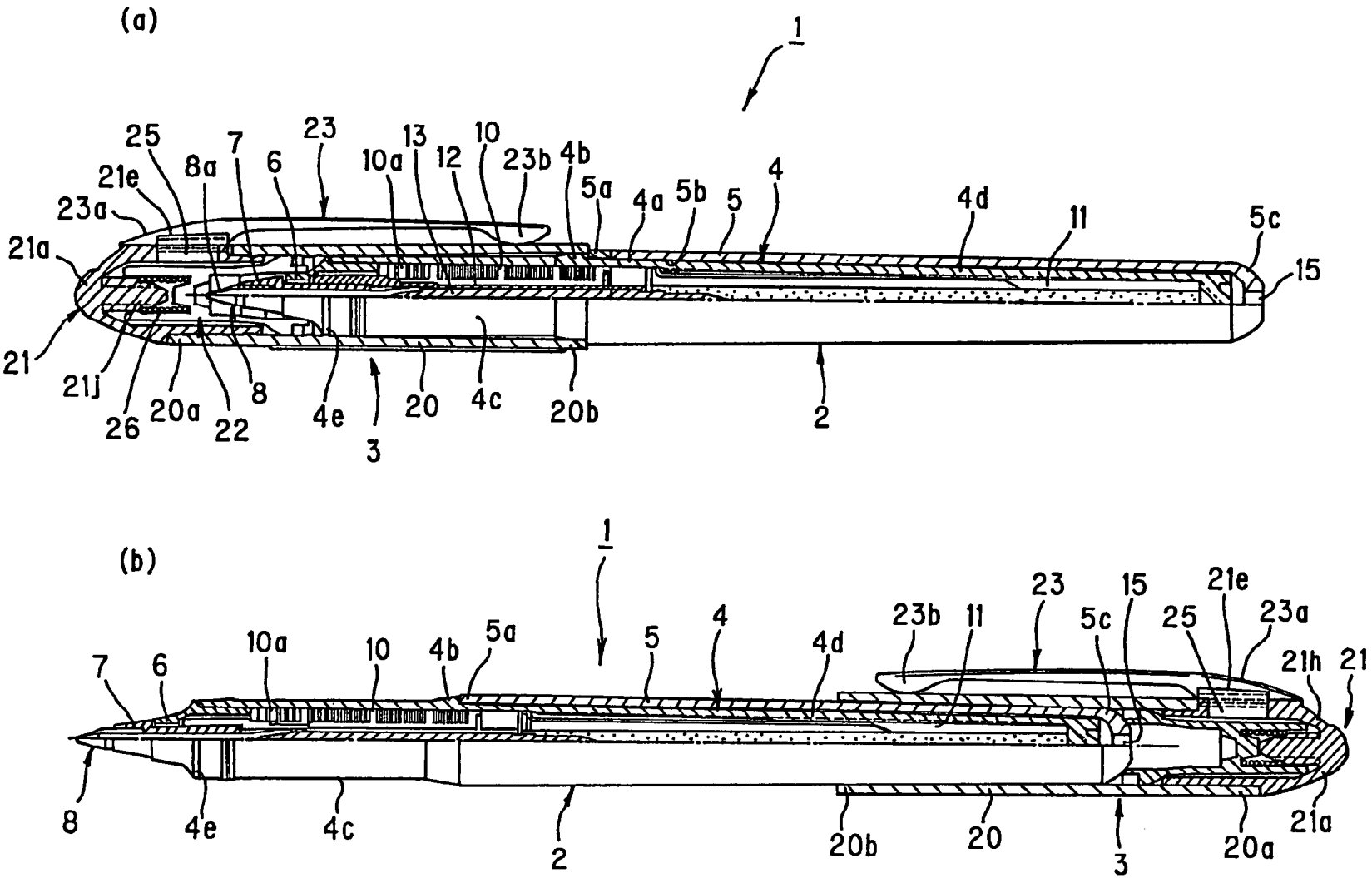
FIG. 1(*a*) is an illustrative view showing an overall configuration of a writing instrument to which a writing instrument cap according to the embodiment of the present invention is fitted, (b) is an illustrative view showing the state where the writing instrument is being used.

The present embodiment is a writing instrument 1 including a writing instrument body 2 and a separate writing instrument cap 3, as shown in FIGS. 1(*a*) and (*b*).

The writing instrument body 2 is comprised of an ink tank portion 4 filled up with ink therein and a rear barrel covering the outer periphery of the rear part of the ink tank portion 4.

In a point assembly 8 in front of the ink tank portion 4, a writing point 8*a* is assembled by means of tip supports 6 and 7. An ink collector 10 is disposed inside ink tank portion 4 in the rear of the point assembly 8 so as to retain ink and prevent ink leakage.

The ink collector 10 has many annular grooves or retaining grooves 10*a* formed on the outer periphery with a longitudinal groove (not shown) formed to connect the retaining grooves 10*a*. This longitudinal groove is connected to an ink chamber 11. When air inside ink chamber 11 expands due to change in temperature or the like and pushes out ink from ink chamber 11, the ink passes through the longitudinal groove and is temporarily stored in retaining grooves 10*a* so that ink will not blot from point assembly 8. Further, when air inside the ink chamber contracts and reverts back to the original state, ink in retaining grooves 10*a* returns to ink chamber 11.

An ink feed insert hole 12 is axially formed in the center of ink collector 10. An ink feed 13 is inserted into this ink feed insert hole 12 and press fitted or loosely fitted in the rear part (the ink chamber side) of the ink feed insert hole 12 while the front end of the ink feed 13 is connected to point assembly 8 so that ink from ink chamber 11 can be supplied to point assembly 8.

Formed on the side surface of ink collector 10, through which ink feed insert hole 12 for attachment of ink feed 13 that feeds ink from ink chamber 11 to point assembly 8 is formed, is a vent hole (not shown) connected to the ink feed insert hole 12.

A thread portion 4*a* is formed on the outer periphery of the ink tank portion 4, in the approximate center with respect to the longitudinal direction so that it can be screwed into rear barrel 5. The external shape of the ink tank portion 4 is constructed so that the front part 4*c*, separated by the thread portion 4*a* from the rear part 4*d*, forms a so-called stepped structure shown generally as stepped portion 4*b*. Part A portion of the ink tank 4, from this stepped portion 4*b* toward the front part 4*c*, is made narrower forming a tapered shape. Rear part 4*d* is made slightly narrower from the thread portion 4*a* to the rear, forming a tapered shape.

The rear barrel 5 is made of transparent resin, and one end, designated at 5*a*, is formed to be open. A thread portion 5*b* is formed on the inside surface in the position corresponding to the thread portion 4*a*. In addition, the rear barrel has a cylindrical external shape slightly tapered from the one end 5*a* to the rear end 5*c*, accommodating the rear part 4*d* of the ink tank portion 4 therein and totally and circumferentially covering the rear part 4*d*.

The one end 5*a* is formed to have a greater diameter than the outside diameter of the stepped portion 4*b* so that the stepped portion 4*b* abuts thereon when the ink tank portion 4 is screw fitted and so that it serves as a so-called stopper when the writing instrument cap 3 is fitted.

The rear end 5*c* forms the rearmost part of the rear barrel 5, having a closed, approximate semi-spherical shape with a vent hole 15 formed at the approximate center so as to connect the interior of the rear barrel 5 and the outside.

The writing instrument cap 3 is comprised of a separate cap body 20 and a crown portion 21. The cap body 20 and crown portion 21 are constructed removably one from the other. An inner cap 22 (FIG. 2) is arranged on the crown portion 21 side inside cap 3 while a clip 23 is provided as a separate part on the outer side of the crown portion 21.

The cap body 20 is made of transparent resin and approximately cylindrical, having a front opening 20*a* at one end to which crown portion 21 is fitted and a rear opening 20*b* (FIG. 1) at the other end to which stepped portion 4*b* (FIG. 1) of the ink tank portion 4 is fitted.

Figure 2:
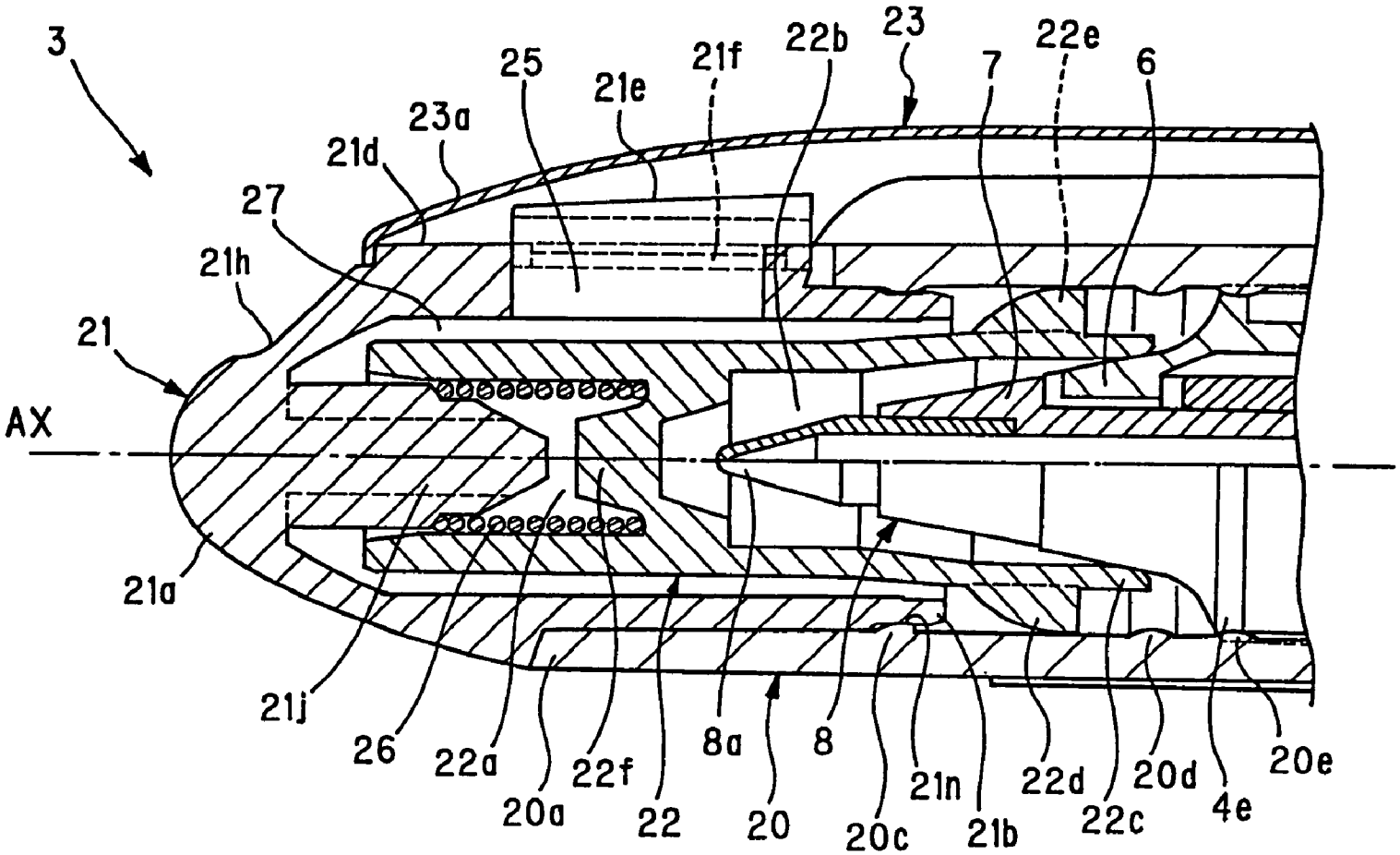
FIG. 2 is a detailed sectional view showing the structure around the point assembly with the writing instrument cap fitted to the pen tip.

As shown in FIG. 2, inside the front opening 20*a*, a crown hold 20*c* for holding and fixing crown portion 21 and an inner cap hold 20*d* for preventing inner cap 22 from dislodging are formed projectively inwards and continuously along the circumference. In addition, a plurality of inwardly projected ink tank holds 20*e* for holding a tip side end 4*e* of the inserted ink tank portion 4 are formed along the circumference.

The inside diameter of the rear opening 20*b* (FIG. 1) is formed to be slightly smaller than the maximum outside diameter of the stepped portion 4*b*, so that the rear opening tightly fits the stepped portion 4*b* when writing instrument cap 3 is fitted to writing instrument body 2.

Figure 4:
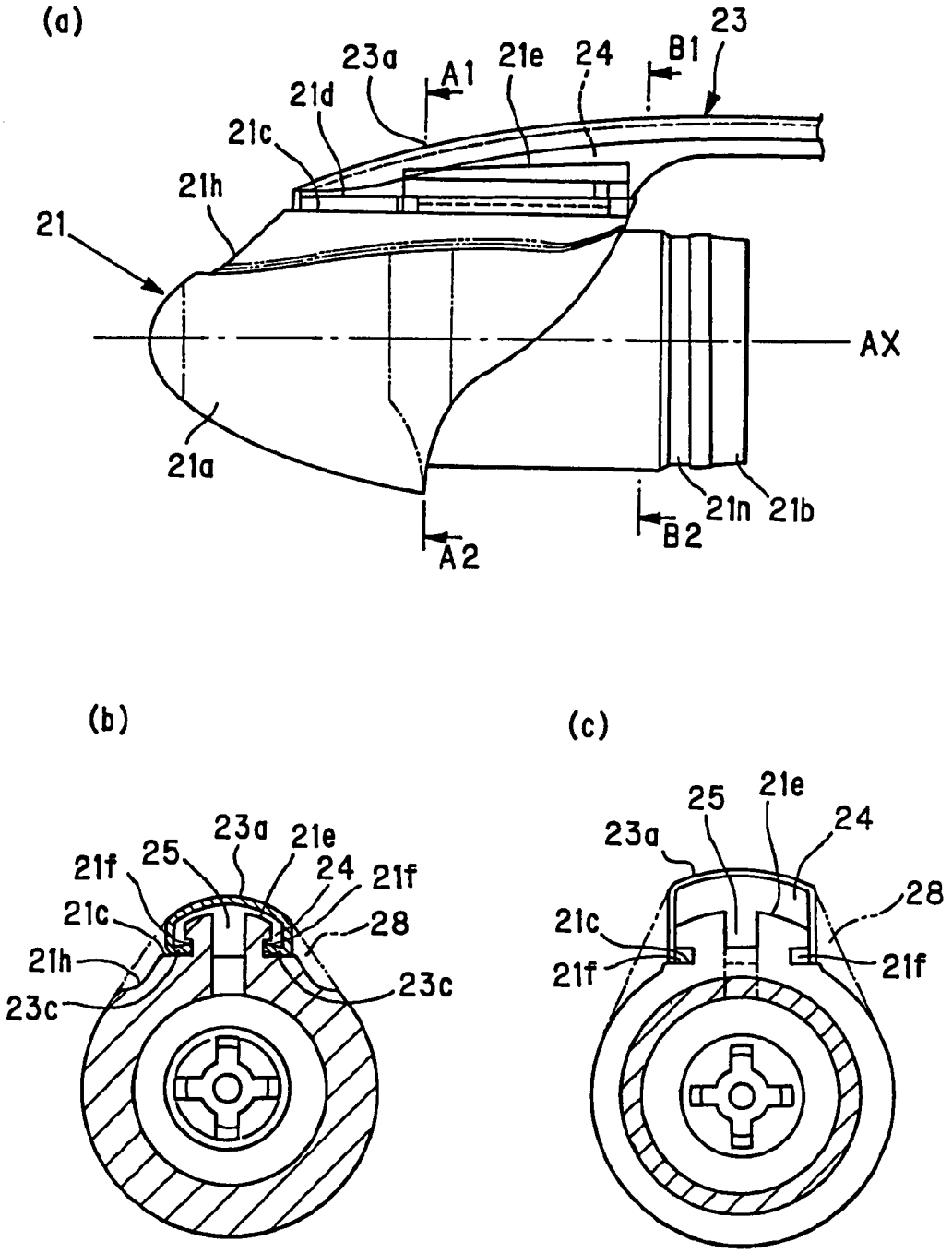
FIG. 4(*a*) is a side view showing the configuration of a crown portion of the writing instrument cap, (b) is a sectional view cut along a plane A1–A2 in (a), and (c) is a sectional view cut along a plane B1–B2 in (a)

The crown portion 21 (FIG. 2, FIG. 4(*a*)) is formed of colored see-through resin, in the shape of an approximate cylinder having a front end 21*a* formed in an approximate semispherical shape or approximate bullet shape and an opening on the other end 21*b* side. That is, crown portion 21 has a hollow therein so that inner cap 22 can be arranged.

A guide portion 21*j* for guiding the inner cap 22 is projected rearwards in the direction of an axis AX (FIG. 2) from the interior of the front end 21*a*.

The outside diameter of the cylinder at the other end 21*b* (FIG. 2 and FIG. 4(*a*)) is specified to be approximately equal to the inside diameter of the front opening 20*a* of the cap body 20. Further, a notch 21*n* is formed in the other end 21*b*, continuously along the circumference on the outer periphery of the front end 21*a*, at a position corresponding to the crown hold 20*c* when the front end 21*a* is fitted to the front opening 20*a* of the cap body 20.

Figure 5:
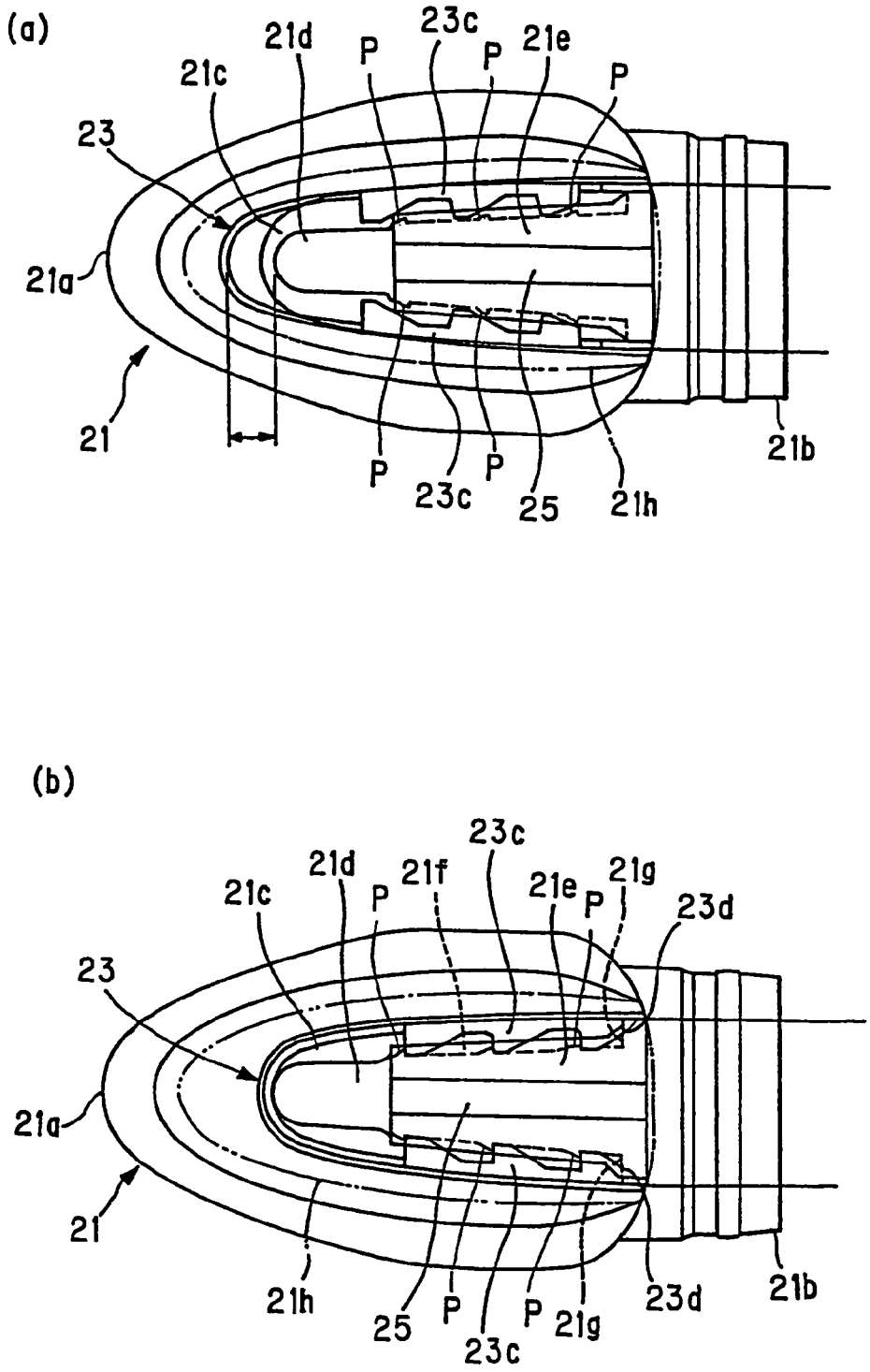
FIG. 5(*a*) is a plan view showing a state where a clip of the present embodiment is attached, (b) is a plan view showing a state where the clip has been assembled.

Further, an attachment surface 21*c* (FIGS. 4(*a*) to (*c*)) on which clip 23 is attached is formed on the outer side portion of the crown portion 21 in its approximately middle part with respect to the longitudinal direction so as to be flat and substantially parallel to the axis AX of crown portion 21. A stopper portion 21*d* which abuts the inner surface of clip 23 and positions the clip 23 is projectively formed on the top of, and approximately parallel to, the attachment surface 21*c*. Also, as shown in FIGS. 5(*a*) and (*b*), a clip attachment 21*e* is projectively formed on the attachment surface 21*c*, from the edge of stopper 21*d* on the other end 21*b* side to the rear. Clip attachment 21*e* has an approximate rectangular, wedge-like shape in the side view (FIG. 2) so that it becomes higher from the front end 21*a* side towards the other end 21*b* side (FIG. 4(*a*)) and has an approximate rectangular, wedge-like shape in the plan view (FIGS. 5(*a*) and (*b*)) so that it becomes wider from the front end 21*a* side towards the other end 21*b* side.

The clip attachment 21*e*, as shown in FIGS. 4(*b*) and (*c*), has guide grooves 21*f* (FIG. 2) formed on the left and right flanks of the raised portion from the attachment surface 21*c*, so that the width becomes narrower.

Further, as shown in FIGS. 4(*b*) and (*c*) and FIGS. 5(*a*) and (*b*), the clip attachment 21*e* has a vent hole 25 which establishes communication between the interior space of crown portion 21 and the outside, in the approximate middle part thereof. The vent hole 25 has a sectional rectangular shape elongated in the direction of axis AX (FIG. 4) of crown portion 21, in the horizontal view (FIGS. 5(*a*) and (*b*)).

The aforementioned two guide grooves 21*f* are formed so that they become more distant from each other (forming a wide, approximately rectangular, wedge-like shape) from the front end 21*a* side toward the other end 21*b* side, in the sectional horizontal view (FIGS. 5(*a*) and (*b*)). Shallow saw-toothed projections P with a predetermined pitch are formed on the side surfaces of the guide grooves 21*f*. Further, a stopper portion 21*g* on which part 23*d* of clip 23 to be guided by the guide grooves 21*f* is formed at the end on the other end 21*b* side of each guide groove 21*f*.

A depressed portion 21*h*, depressed with respect to the external form of the front end 21*a* is formed as shown in FIG. 4(*a*) along the contour of the attachment surface 21*c*, on the outer side surface of the crown portion 21, so as to lower toward the front end or in such a manner that it drops closer to the axis AX of crown portion 21 on the front end 21*a* side and becomes less closer to the axis AX as it goes toward the other end 21*b*.

Depressed portion 21*h* provides direct communication between the front end 21*a* side and the other end 21*b* and/or communication between the front end 21*a* side and the interior of crown portion 21 by way of vent hole 25 when crown portion 21 is accidentally swallowed.

The clip 23 is formed of metal so that the length of the clip 23 is shorter than the length of writing instrument cap 3, as shown in FIG. 1. The clip has an attachment portion 23*a* for attachment to the cap at one end and a free end 23*b* at the other end.

To cover the clip attachment 21*e*, the attachment portion 23*a* is formed, as shown in FIG. 2 and FIGS. 4(*a*) to (*c*), so that its edge has an approximate L-shaped section, in the side view (FIG. 4(*b*)), opposing the side wall of the clip attachment 21*e* and so that the front part is curved in a semi-circular shape, in the plan view (FIGS. 5(*a*) and (*b*)). Further, part of the inner wall of the attachment portion 23*a* is formed so as to abut the front end of the stopper portion 21*d*.

Therefore, the opposing part of attachment portion 23*a* to the clip attachment 21*e* has an approximate C-shaped section (bottom-opening C) when viewed from the side, as shown in FIGS. 4(*b*) and (*c*).

Each edge of attachment portion 23*a* opposing to the guide groove 21*f* is bent and projected in the depth direction of the guide groove, as shown in FIG. 4(*b*). The opposing projected edges are formed along the guide grooves 21*f* so as to become more distant, one from the other, from the front end 21*a* side to the other end 21*b* side in the horizontal view, forming a gripping portion 23*c* with saw-toothed configurations, as shown in FIG. 5. The part of attachment portion 23*a* (on the free portion 23*b* side) located in the rear of the clip attachment 21*e* has an approximate U-shaped section (bottom-opening U) when viewed from the side, as shown in FIG. 4(*c*).

As shown in FIG. 5(*b*), each end 23*d* of the gripping portion 23*c* located on the other end 21*b* side abut stopper portion 21*g* of the guide groove 21*f* so as to position the clip 23.

When clip 23 is attached in place to the clip attachment 21*e*, a clearance is formed between the clip attachment 21*e* and attachment portion 23*a*, forming an air passage 24, as shown in FIG. 4(*b*). Air passage 24 establishes communication between vent hole 25 and crown portion 21 and also makes communication between vent passage 25 and depressed portion 21*h*.

The inner cap 22, as shown in FIG. 2, has the outside shape of an approximate cylinder having an outside diameter smaller than the inside diameter of the hollow of crown portion 21, creating a space between the outer peripheral wall of the inner cap 22 and the inner peripheral wall of the crown portion 21, thus defining an air passage 27.

The air passage 27 is connected to the outside of writing instrument cap 3 by way of the vent hole 25.

The inner cap 22 has a guide hole 22*a* at one end, into which guide portion 21*j* of crown portion 21 is inserted. A coil spring 26 is arranged in the guide hole 22*a*. The other end of inner hollow cap 22 is formed with a hollow 22*b* in which point assembly 8 is accommodated so that writing point 8*a* is kept out of contact with the inner wall of inner cap 22 while part of the outer periphery of the point assembly 8 abuts the opening rim 22*c*.

Projected from the bottom of the guide hole 22*a* toward the opening side is a stopper portion 22*f*, which is positioned so as not to abut the guide portion 21*j* when point assembly 8 is accommodated in place in the writing instrument cap 3.

Inner hollow cap 22 has a plurality of guide vanes 22*d* projectively formed on its outer periphery closer to the other end 22*c* and arranged circumferentially. These guide vanes guide the inner peripheral wall of cap body 20, so that the outer peripheral wall of inner cap 22 will be kept out of contact with the inner peripheral wall of cap body 20 and so that inner cap 22 can be slid. Air channels 22*e* are defined between adjoining guide vanes 22*d* so as to establish communication between the cap's front end 21*a* side and the writing element 1 side inside the inner cap 22. Thereby the space on the writing element 1 side is adapted to communicate with the front space of cap 3 by way of air channels 22*e*, air passage 27, vent hole 25, air passage 24 and depressed portion 21*h*.

Next, attachment of the writing instrument cap of the present embodiment will be described.

When writing instrument 1 is unused, writing instrument cap 3 is fitted on point assembly 8 of writing instrument 1 so as to avoid exposure of point assembly 8 or its accidental staining, as well as to avoid drying of the writing point.

In this state, writing instrument cap 3, as shown in FIG. 1(*a*) and FIG. 2, is fitted on and held by ink tank portion 4 in such a manner that rear opening 20*b* fits stepped portion 4*b* of ink tank portion 4 while abutting one end 5*a* of rear barrel 5 and tip side end 4*e* fits into ink tank hold 20*e*. Point assembly 8 inside writing instrument cap 3 is positioned so as to thrust inner cap 22 against crown portion 21.

The inner cap 22 is urged against point assembly 8 by means of coil spring 26 while guide portion 21*j* of crown portion 21 is kept out of contact with stopper portion 22*f* of the inner cap 22 (FIG. 2). By this arrangement, opening rim 22*c* seals point assembly 8 so as to hermetically keep the point assembly inside the hollow 22*b*.

On the other hand, when writing instrument 1 is used, writing instrument cap 3 is removed from the front end of writing instrument body 2 and attached to the rear end of the writing instrument body 2.

Figure 3:
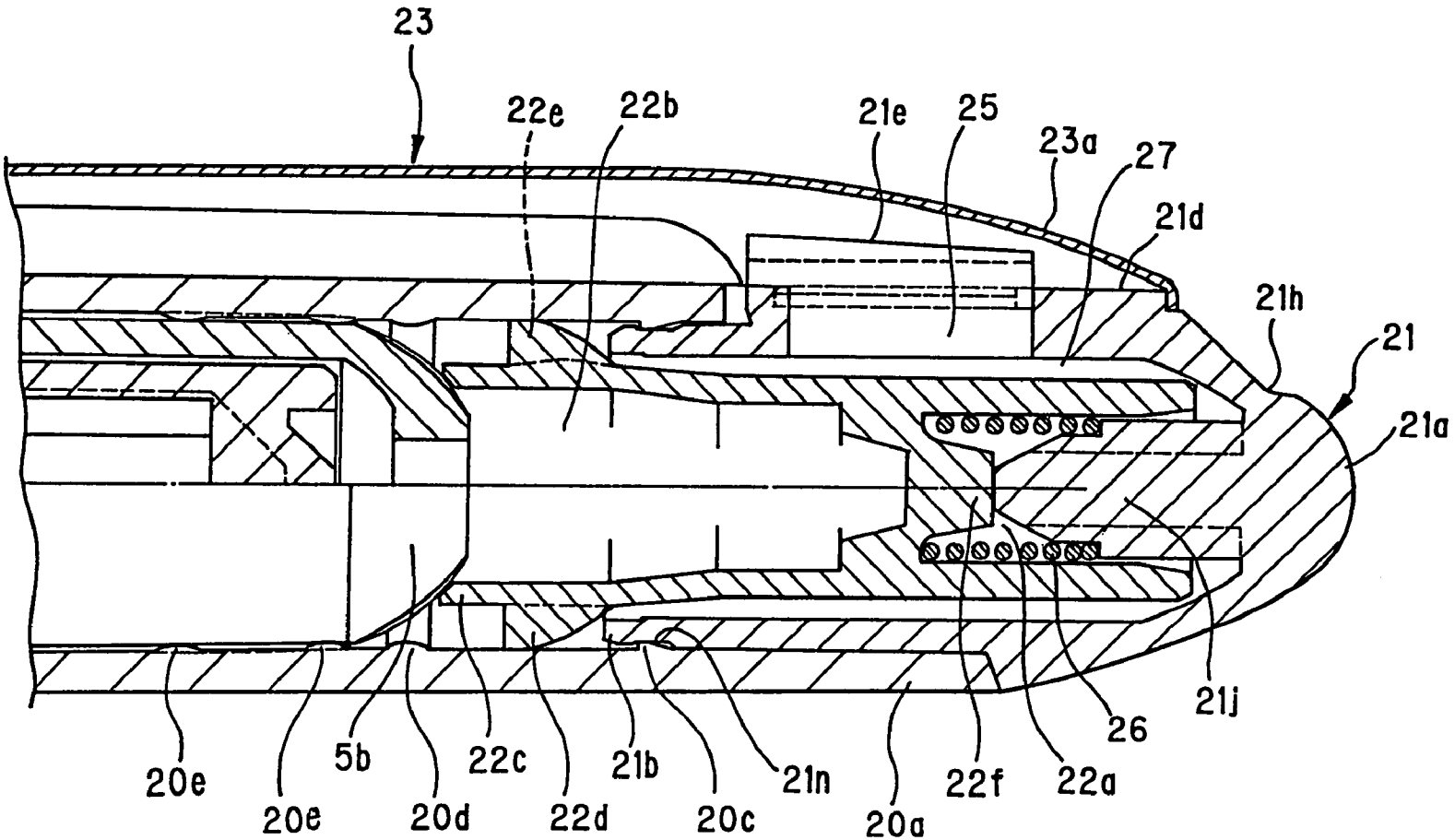
FIG. 3 is a detailed sectional view showing the structure around the rear end of the writing instrument with the writing instrument cap fitted to the rear end.

In this situation, writing instrument cap 3 is attached to rear barrel 5 in a manner that inner cap hold 20*d* and ink tank hold 20*e* tightly fit rear end 5*c* of rear barrel 5 while inner cap 22 is thrust, as shown in FIG. 1(*b*) and FIG. 3.

In this case, rear end 5*c* presses coil spring 26 so as to push inner cap 22 in to writing instrument cap 3 until stopper portion 22*f* abuts guide portion 21*j* of crown portion 21, whereby the cap is attached in the predetermined position in the rear end of rear barrel 5 (FIG. 3).

According to the present embodiment thus configured, since separate inner cap 22 is arranged inside writing instrument cap 3, it is possible for writing instrument cap 3 to protect writing point 8*a* and prevent writing point 8*a* from drying when the writing instrument is unused. Since a plurality of guide vanes 22*d* are formed on the outer periphery of the inner cap 22, it is possible to make communication between the spaces before and behind inner cap 22 in cap 3. As a result, the spaces before and behind inner cap 22 are connected to the spaces before and behind cap 3, whereby it is possible to avoid a choking hazard by air channels 22*e* created by guide vanes 22*d* in case writing instrument cap 3 is accidentally swallowed.

Further, since depressed portion 21*h* is formed along the contour of the clip attachment 21*e* of the crown portion 21 so that the depressed portion 21*h* creates air passages 28 in the front end 21*a*-to-rear end 21*b* direction and in the front end 21*a*-to-vent hole 25 direction as shown in FIGS. 4(*b*) and (*c*), it is possible to enhance ventilation in corporation with vent hole 25 which is formed on the outer periphery of crown portion 21, even when writing instrument cap 3 is accidentally swallowed.

Since clip 23 is constructed so that it can slide from the front end 21*a* side to the other end 21*b* side along guide grooves 21*f* formed on the flank portions of clip attachment 21*e* that is projected on the outer side of writing instrument cap 3, and fits into the guide grooves 21*f*, this makes clip attachment work easy.

Further, since writing instrument cap 3 is constructed of cap body 20 and crown portion 21 which can be separated and put together, complex writing instrument cap 3 can be designed and manufactured from separate parts. As a result, the configurations of the parts of cap 3 can be simplified, and partial modifications can be added. Furthermore, since the cap can be assembled easily, it is possible to improve assembly performance.

Since the length of clip 23 is specified so as not to exceed the length of cap body 20, the clip does not project beyond the end of cap 20, hence provides its function without snagging and makes itself stylish in appearance.

In the present embodiment, guide vanes 22*d* for creating an up-and-down configuration on the outer periphery of inner cap 22 are provided so as to define air channels 22*e* that extend in the longitudinal direction of inner cap 22, in cooperation with cap body 20. However, the shape of the inner cap should not be limited to this, and any configuration can be used as long as it will create air channels extending in the longitudinal direction around the outer periphery of the inner cap. For example, ventilation grooves may be provided in the outer periphery of the inner cap. Alternatively, the inner cap may be formed with a tubular vent hole so that the inner cap by itself can create an air channel.

In the present embodiment, gripping portion 23*c* formed in clip 23 is attached to clip attachment 21*e*, but the method of attachment of the clip should not be limited thereto. This means that any configuration can be used as long as vent hole 25 formed in the clip attachment can be covered by a separate clip so that the vent hole 25 cannot be externally seen and air passage 24 can be formed between clip attachment 21*e* and clip 23.

Further, in the present embodiment, the constituent parts of the writing instrument are formed of transparent resin so that the interior structure is visible. But the present invention should not be limited to this, the parts may be formed of opaque material, and should not be limited to particular colors.

Next, the second embodiment according to the present invention will be described in detail with reference to the drawings.

Figure 6:
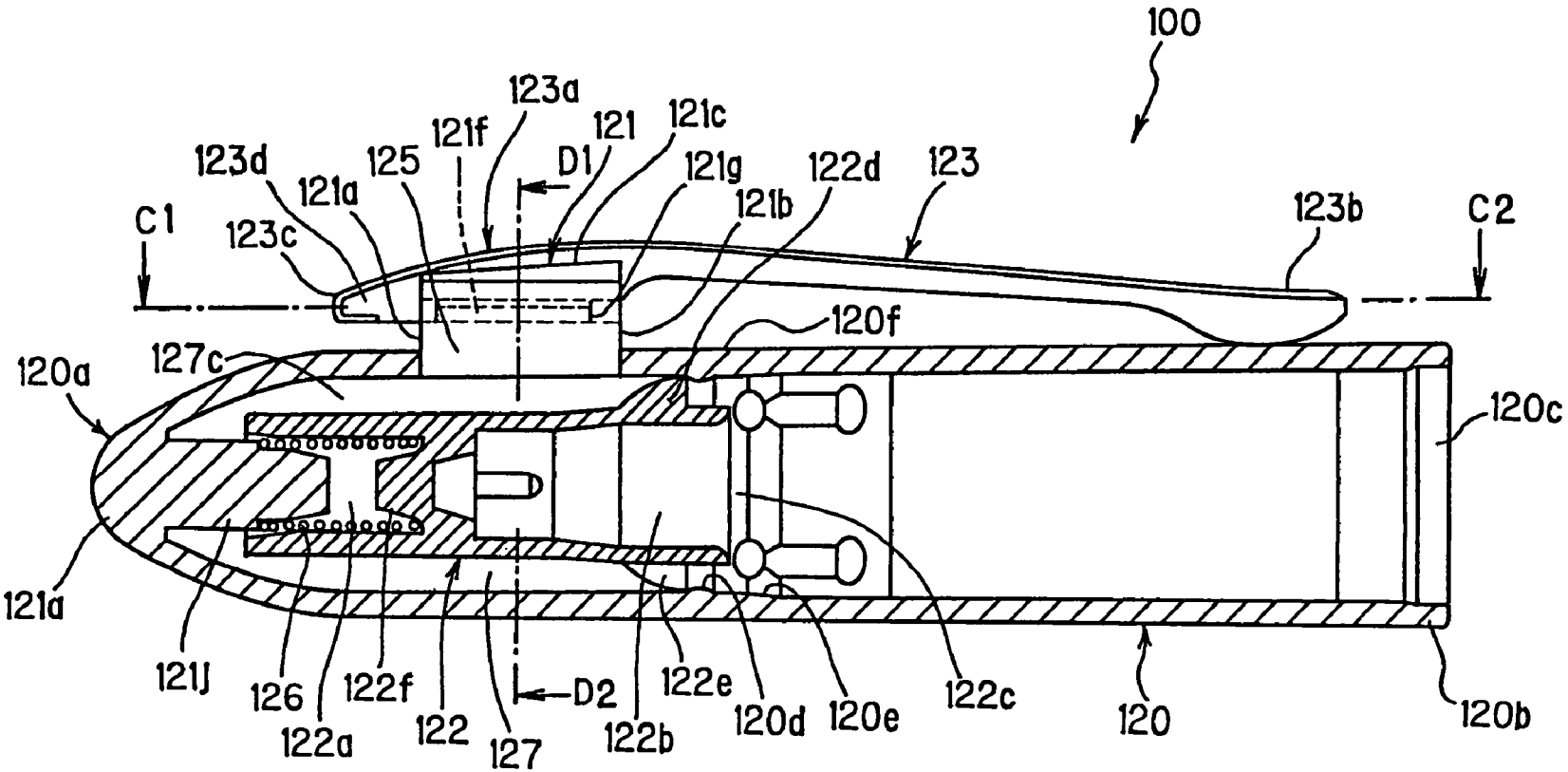
FIG. 6 is a sectional view showing the overall configuration of a writing instrument cap in accordance with the second embodiment of the present invention.
Figure 7:
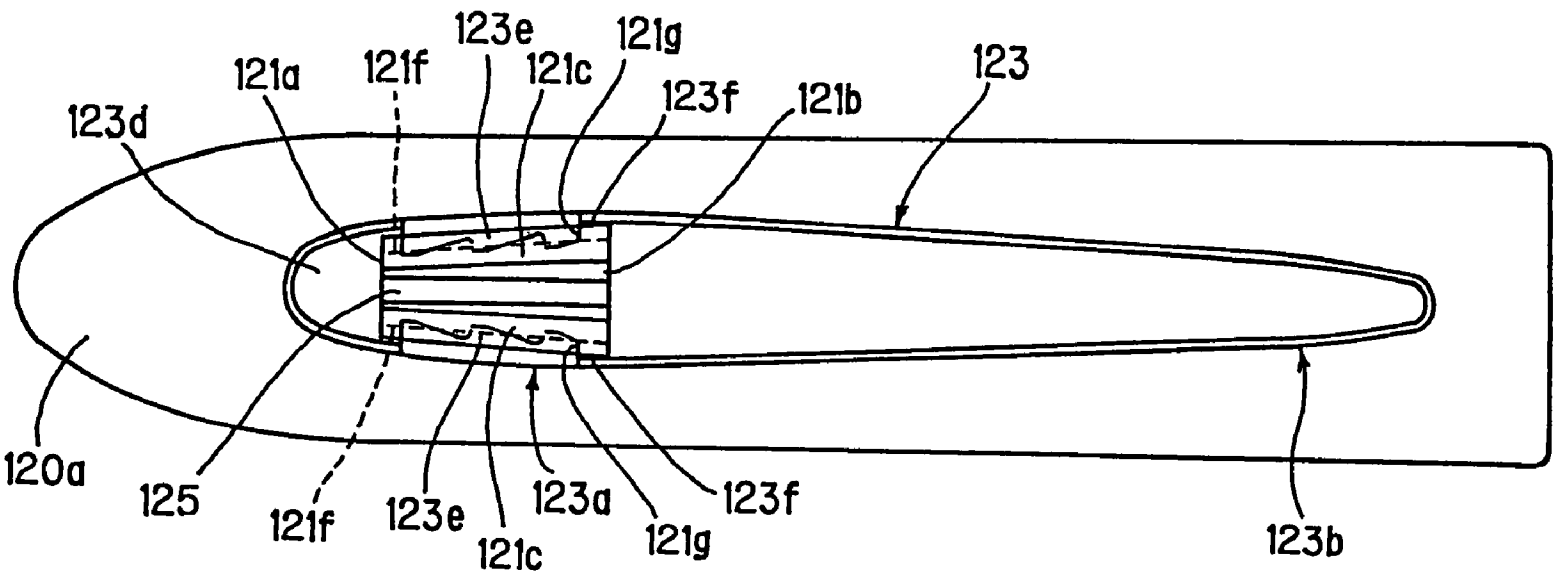
FIG. 7 is a sectional view cut along a plane C1–C2 in FIG. 6.
Figure 8:
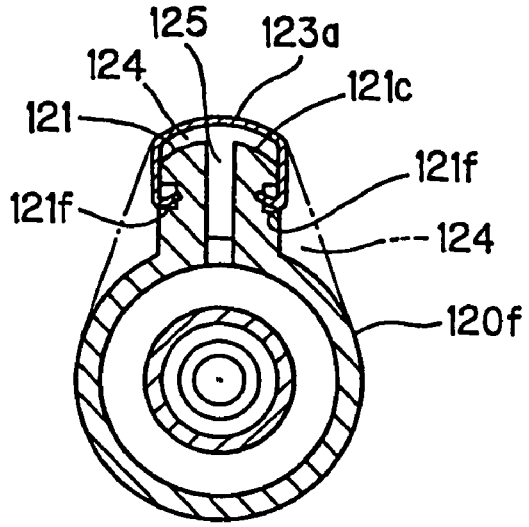
FIG. 8 is a sectional view cut along a plane D1–D2 in FIG. 6.

FIGS. 6 to 8 shows the second embodiment of the present invention, FIG. 6 is a sectional view showing the overall configuration of a writing instrument cap according to the second embodiment of the present invention; FIG. 7 is a sectional view cut along a plane C1–C2 in FIG. 6; and FIG. 8 is a sectional view cut along a plane D1–D2 in FIG. 6.

In the drawings, parts with the same reference numerals as those in FIGS. 1 to 5 represent the same components and the description is omitted.

As shown in FIGS. 6 to 8, the second embodiment is a writing instrument cap 100 which is comprised of one-piece cap body 120, an inner cap 122 arranged therein and a separate clip 123 provided on the outer side.

The cap body 120 is made of transparent resin, having the overall shape of an approximate cylinder, with a front end 120*a* of an approximate semispherical shape or approximate bullet shape.

The front end 120*a* is formed with a guide portion 121*j* which is projected rearwards in the direction of the axis from the interior thereof so as to guide the inner cap 122.

Formed at the opening rear end 120*b* of cap body 120 is an opening 120*c* to which point assembly 8 is fitted.

As shown in FIG. 6, inside the front end part 120*a*, an inner cap hold 120*d* for preventing inner cap 122 from dislodging is formed projectively inwards and continuously along the circumference. In addition, a plurality of inwardly projected ink tank holds 120*e* for holding a tip side end 4*e* (FIG. 2) to be inserted are formed along the circumference.

The inside diameter of the opening 120*c* is formed to be slightly smaller than the outside diameter of the stepped portion 4*b* (FIG. 1), so that a tight fit is formed when writing instrument cap 100 is attached to writing instrument body 2.

Formed projectively and integrally with cap body 120 on its outer periphery 120*f*, on the front end 121*a* side with respect to the longitudinal center of the cap body 120, is a clip attachment 121, as shown in FIGS. 6 and 7, which is approximately rectangular, when viewed from the side and viewed from the top.

A top surface 121*c* of the clip attachment 121 has an approximately rectangular, wedge-like shape in the side view (see FIG. 6) so that it becomes higher from the front end 121*a* side towards the other end 121*b* side and has an approximate rectangular, wedge-like shape in the plan view (see FIG. 7) so that it becomes wider from the front end 121*a* side towards the other end 121*b* side.

The clip attachment 121, as shown in FIGS. 7 and 8, has guide grooves 121*f* formed on the left and right flanks of the raised portion from the outer periphery 120*f*, so that the width becomes narrower.

Further, as shown in FIGS. 6 to 8, the clip attachment 121 has a vent hole 125 which establishes communication between the interior space of cap body 120 and the outside, in the approximate middle part thereof. The vent hole 125 has a rectangular shape elongated in the axial direction in the horizontal view (FIG. 7).

The aforementioned guide grooves 121*f* are formed so that they form a wide, approximate rectangular wedge-like shape from the front end 121*a* side toward the other end 121*b* side, in the horizontal view (FIG. 7), and shallow saw-toothed projections are formed on part of the side surfaces of the guide grooves 121*f*. Further, a stopper portion 121*g* on which part of clip 123 is guided from the front end side of the guide grooves 121*f* is formed at the end on the other end 121*b* side of each guide groove 121*f*.

The clip 123 is formed of metal so that the length of the clip 123 is shorter than the length of cap body 120, as shown in FIG. 6. The clip has an attachment portion 123*a* for attachment to the cap body 120 at one end and a free end 123*b* at the other end.

The attachment portion 123*a* covers the upper part of clip attachment 121, as shown in FIGS. 6 and 7, with its front end 123*c* projected in front of the clip attachment 121, as viewed from the side (FIG. 6). In the horizontal view (FIG. 7), the front part is curved in semi-circular shape, to create a hollowed portion 123*d* in front of clip attachment 121.

The opposing part of attachment portion 123*a* to the clip attachment 121 is bent in an approximate C-shaped section (bottom-opening C) when viewed from the side, as shown in FIG. 8, so as to form an approximate saw-toothed gripping portion 123*e* having wide distance from one edge to the other, from the front end 121*a* side to the other end 121*b* side along guide groove 121*f* when viewed from the top, as shown in FIGS. 7 and 8. The rear part close to the end of the clip attachment 121 has an approximate U-shaped section (bottom-opening U) when viewed from the side.

Each end 123*f* of the gripping portion 123*e* located on the other end 121*b* side abuts stopper portion 121*g* of the guide groove 121*f* so as to position the clip 23 when clip 123 is fitted into guide grooves 121*f* of clip attachment portion 121.

When clip 123 is attached in place to the clip attachment 121, a clearance is formed between the clip attachment 121 and attachment portion 123*a*, forming an air passage 124, as shown in FIG. 8.

Air passage 124 establishes communication between vent hole 125 and the outside of cap body 120 and also makes communication between vent hole 125 and the outside of the front end 120*a* of the cap body 120 by way of hollowed portion 123*d*.

The inner cap 122 (FIG. 6), has the outside shape of an approximate cylinder having an outside diameter smaller than the inside diameter of the hollow of cap body 120, creating a space between the outer peripheral wall of the inner cap 122 and the inner peripheral wall of cap body 120, thus defining an air passage 127.

The air passage 127 is connected to the outside of cap body 120 by way of the vent hole 125 and air passage 124.

The inner cap 122 has a guide hole 122*a* at one end, into which guide portion 121*j* of front end 120*a* of cap body 120 is inserted. A coil spring 126 is arranged in the guide hole 122*a*. The other end is formed with a hollow 122*b* in which point assembly 8 (FIG. 1) is accommodated so that writing point 8*a* (FIG. 1) is kept out of contact with the inner wall of inner cap 122 while part of the outer periphery of the point assembly 8 abuts the opening rim 122*c*.

Projected from the bottom of the guide hole 122*a* toward the opening side is a stopper portion 122*f*, which is positioned so that the stopper portion 122*f* will not abut guide portion 121*j* when point assembly 8 is accommodated in place in cap body 120.

Inner cap 122 has a plurality of guide vanes 122*d* projectively formed on its outer periphery closer to the opening rim 122*c* and arranged circumferentially. These guide vanes 122*d* guide the inner peripheral wall of cap body 120, so that the outer peripheral wall of inner cap 122 will be kept out of contact with the inner peripheral wall of cap body 120 and so that inner cap 122 can be slid. Air channels 122*e* are defined between adjoining guide vanes 122*d* so as to establish communication between the cap's front end side and the writing element side inside the inner cap 122.

Next, attachment of the writing instrument cap of the second embodiment will be described.

Handling of writing instrument cap 100 (FIG. 6) in the writing instrument is made in much the same manner as in the first embodiment.

That is, when the writing instrument is unused, writing instrument cap 100 is fitted on point assembly 8 (FIG. 1) of the writing instrument so as to avoid exposure of point assembly 8 or its accidental staining as well as to avoid drying of the writing point.

In this state, writing instrument cap 100, as shown in FIG. 1(*a*) and FIG. 6, is fitted on and held by ink tank portion 4 in such a manner that opening 120*c* at rear end 120*b* fits stepped portion 4*b* of ink tank portion 4 while abutting one end 5*a* of rear barrel 5 and tip side end 4*e* fits into ink tank hold 120*e*. Point assembly 8 inside writing instrument cap 100 is positioned so as to thrust inner cap 122.

The inner cap 122 is urged against point assembly 8 by means of coil spring 126 while guide portion 121*j* of cap body 120 is kept out of contact with stopper portion 122*f* of the inner cap 122. By this arrangement, opening rim 122*c* seals point assembly 8 so as to hermetically keep the point assembly inside the hollow 122*b*.

On the other hand, when the writing instrument is used, writing instrument cap 100 is removed from the front end of writing instrument body 2 and attached to the rear end of the writing instrument body 2.

In this situation, writing instrument cap 100 is attached to rear barrel 5 in the same manner as shown in FIG. 1(*b*) such that inner cap hold 120*d* and ink tank hold 120*e* tightly fit rear end 5*c* of rear barrel 5 while inner cap 122 is thrust.

The cap body 120 is attached in the predetermined position of the rear end of rear barrel 5, in such a manner that rear end 5*c* (FIG. 1) presses coil spring 126 so as to push inner cap 122 into cap body 120 until stopper portion 120*f* abuts guide portion 121*j* of cap body 120.

According to the second embodiment thus configured, since inner cap 122 is arranged inside cap body 120 and the plurality of guide vanes 122*d* are formed on the outer periphery of the inner cap 122 in the same manner as in the first embodiment, it is possible for writing instrument cap 100 to protect writing point 8*a* and prevent writing point 8*a* from drying when the writing instrument is unused and air channels 122*e* formed by guide vanes 122*d* secure communication between air passage 127 connected to the outer space on the writing tip 120*a* side and opening 120*c* in case the writing instrument cap 100 is accidentally swallowed, whereby it possible to avoid a choking hazard.

Since clip 123 is constructed so that it is attached to guide grooves 121*f* formed on the flank portions of clip attachment 121 that is projected on the outer periphery 120*f* of cap body 120, this makes clip attachment work easy.

Since the length of clip 123 is specified so as not to exceed the length of cap body 120 as in the first embodiment, the clip does not project beyond the cap end, this arrangement hence provides the function without snagging and makes itself stylish in appearance.

Further, since, in writing instrument cap 100, cap body 120 is configured integrally with clip attachment 121, differing from the configuration of the first embodiment, it is possible to reduce the number of parts and simplify assembly of writing instrument cap 100. Thus, assembly work performance can be improved.

In the second embodiment, similarly to the first embodiment, guide vanes are provided on the outer periphery of inner cap 122 so as to create air channels. However, the shape of inner cap 122 should not be limited to this, and any configuration can be used as long as it will create air passage 127 around the outer periphery of inner cap 122. For example, ventilation grooves or vent holes may be provided in the outer periphery of inner cap 122.

In the second embodiment, gripping portion 123*e* is formed in clip 123 and is attached to clip attachment 121 as in the first embodiment, but the method of attachment of the clip should not be limited thereto. This means that any configuration can be used as long as vent hole 125 formed in clip attachment 121 can be covered by separate clip 123 so that the vent hole 125 cannot be externally seen and air passage 124 can be formed between clip attachment 121 and clip 123.

Further, in the second embodiment, the constituent parts of the writing instrument are formed of transparent resin so that the interior structure can be seen. But the present invention should not be limited to this, the parts may be formed of opaque material, and should not be limited to particular colors.

Next, a variational example of writing instrument cap 100 of the second embodiment will be described.

Figure 9:
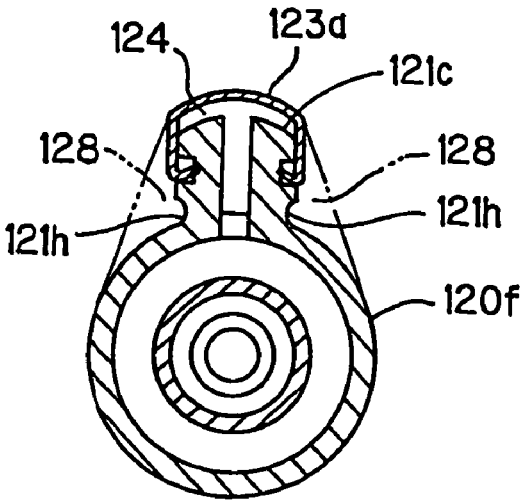
FIG. 9 is a sectional view showing a writing instrument cap of a variational example of the second embodiment.

As shown in FIG. 9, in the variational example of the second embodiment, a depressed portion 121*h* is formed on the outer periphery 120*f* of cap body 120 so as to dip along the contour of the proximal portion of clip attachment 121 and so as to lower toward the front end, or more specifically so that it becomes closer to axis AX as it goes to the front end 121*a* side and more distant from axis AX as it goes to the other end 121*b* (FIG. 6).

According to this variational example, provision of depressed portion 121*h* along the contour of clip attachment 121, makes it possible to create a greater air passage 128 with depressed portion 121*h* as shown in FIG. 9, in case writing instrument cap 3 is accidentally swallowed. Accordingly, it is possible to improve the ventilation together with air passage 124 which is formed on the outer periphery of cap body 120.

As has been described, according to the writing instrument caps defined in claims 1 to 6 of the present invention, a vent hole communicating with the interior of the cap is formed in the clip attachment projectively formed on the outer periphery of the cap, and a clip as a separate part is attached to the clip attachment. In this way, with the simple structure, it is possible to cover the clip attachment and the vent hole and create an air passage between the clip and clip attachment. As a result, it is possible to highly effectively realize a safe structure which can secure an air passage even in a case where the cap is accidentally swallowed, without degrading any stylishness in appearance.

INDUSTRIAL APPLICABILITY

The writing instrument cap according to the present invention is suitable for a writing instrument cap which can secure ventilation passage when accidentally swallowed.

What is claimed is:

1. A writing instrument cap having a clip as a separate part, characterized in that a clip attachment to which the clip is fitted is projectively formed on the outer periphery of the writing instrument cap, the clip attachment is formed with a vent hole penetrating between the interior and exterior of the writing instrument cap and raised portions for attachment of the clip, the raised portions being provided on both sides of the vent hole with respect to the circumference of the writing instrument cap;

in the state where the clip is attached to the clip attachment, the clip covers the clip attachment and the vent hole and creates a clearance between a clip interior and the clip attachment so as to establish an air passage that communicates between the vent hole and the outside atmosphere;

an inner cap is provided in the interior of the writing instrument cap for sealing a vicinity of a point assembly of a writing instrument body; and, an air channel that communicates between spaces being separated by the inner cap, or a front end side space and a writing instrument body side space, inside the writing instrument cap, is formed around an outer periphery of the inner cap.

2. The writing instrument cap according to claim 1, wherein the writing instrument cap has a depressed portion formed along a contour of the clip attachment with respect to a direction of an axis of the writing instrument cap.

3. The writing instrument cap according to claim 1, wherein the clip has an attachment portion at one end thereof to be attached to the writing instrument cap and the attachment portion is arranged on the outer periphery of the writing instrument cap so as not to extend beyond a front end of the writing instrument cap while the other clip end is formed to be a free end, which is arranged on the periphery of the writing instrument cap so as not to extend beyond a cap's writing instrument body side end.

4. The writing instrument cap according to claim 1, wherein the vent hole formed in the writing instrument cap is configured so as not to be visible.

5. A writing instrument cap having a clip as a separate part, characterized in that:

a clip attachment to which the clip is filled is projectively formed on an outer periphery of the writing instrument cap;

the clip attachment is formed with a vent hole penetrating between the interior and exterior of the writing instrument cap;

in the state where the clip is attached to the clip attachment, the clip covers the vent hole and creates a clearance between a clip interior and the clip attachment so as to establish an air passage that communicates between the vent hole and the outside atmosphere;

an inner cap is provided in the interior of the writing instrument cap for sealing a vicinity of a point assembly of a writing instrument body;

an air channel that communicates between spaces being separated by the inner cap, or a front end side space and a writing instrument body side space, inside the writing instrument cap, is formed around an outer periphery of the inner cap; and the writing instrument cap is composed of a cap body and a crown portion which are separable one from the other, and the clip attachment is formed in the crown portion.

6. The writing instrument cap according to claim 5, wherein the writing instrument cap has a depressed portion formed along a contour of the clip attachment with respect to a direction of an axis of the writing instrument cap.

7. The writing instrument cap according to claim 5, wherein the clip has an attachment portion at one end thereof to be attached to the writing instrument cap and the attachment portion is arranged on the outer periphery of the writing instrument cap so as not to extend beyond a front end of the writing instrument cap while the other clip end is formed to be a free end, which is arranged on the periphery of the writing instrument cap so as not to extend beyond a cap's writing instrument body side end.

8. The writing instrument cap according to claim 5, wherein the vent hole formed in the writing instrument cap is configured so as not to be visible.

* * * * *

UNITED STATES PATENT AND TRADEMARK OFFICE

CERTIFICATE OF CORRECTION

PATENT NO. : 6,974,272 B2
APPLICATION NO. : 10/433945
DATED : December 13, 2005
INVENTOR(S) : Kazuhiko Furukawa et al.

It is certified that error appears in the above-identified patent and that said Letters Patent is hereby corrected as shown below:

Title page,
Item [56], References Cited, FOREIGN PATENT DOCUMENTS, add

| | | | |
|---|---|---|---|
| -- 7-56226 | Y2 | Japan | 12-25-1995 |
| 7-56228 | Y2 | Japan | 12-25-1995 |
| 2542158 | Y2 | Japan | 04-25-1997 --. |

Signed and Sealed this

Twentieth Day of June, 2006

JON W. DUDAS
*Director of the United States Patent and Trademark Office*